United States Patent [19]

DeWald

[11] Patent Number: 4,871,376

[45] Date of Patent: Oct. 3, 1989

[54] RESIN SYSTEMS FOR COATED PRODUCTS; AND METHOD

[75] Inventor: Carolyn G. DeWald, St. Paul, Minn.

[73] Assignee: Minnesota Mining and Manufacturing Company, St. Paul, Minn.

[21] Appl. No.: 132,485

[22] Filed: Dec. 14, 1987

[51] Int. Cl.[4] ..... C09K 3/14

[52] U.S. Cl. ..... 51/298; 428/143; 428/283

[58] Field of Search ..... 51/298; 428/143, 240, 428/241, 252, 283, 265, 266; 523/212, 213, 216

[56] References Cited

U.S. PATENT DOCUMENTS

| | | | |
|---|---|---|---|
| 2,322,156 | 6/1943 | Oglesby | 52/298 |
| 2,534,805 | 12/1950 | Waterfield | 51/297 |
| 2,873,181 | 2/1959 | Hanford | 51/298 |
| 2,878,111 | 3/1959 | Daniels et al. | 51/298 |
| 3,041,156 | 6/1962 | Rowse et al. | 51/298 |
| 3,098,730 | 7/1963 | Rowse | 51/298 |
| 4,225,321 | 9/1980 | Swiatek | 51/298 |
| 4,478,610 | 10/1984 | Parekh et al. | 51/298 |
| 4,543,106 | 9/1985 | Parekh | 51/298 |

FOREIGN PATENT DOCUMENTS 1334920 10/1973 United Kingdom .

*Primary Examiner*—James J. Bell

*Attorney, Agent, or Firm*—Donald M. Sell; Walter N. Kirn; Richard Francis

[57] ABSTRACT

Improved resin/filler compositions for use in forming coated abrasives having a substrate/bonding system/abrasive composite structure, are provided. Also, methods for making such improvements are described. In general, the improvements result from inclusion in the resin/filler composition, a coupling agent providing for bonding between the resin and the filler. Preferred classes of coupling agents comprise: silanes, titanates, and zircoaluminates. Improvements effected by methods according to the present invention concern: viscosity of resulting resin/filler mixtures, retention of filler in suspension with a resin, and improved performance characteristics of products made according to the method, in particular improved resistance to deterioration upon contact with water, or upon use and/or storage in humid environments.

22 Claims, No Drawings

RESIN SYSTEMS FOR COATED PRODUCTS; AND METHOD

FIELD OF THE INVENTION

The present invention concerns improved bond systems for abrasive products particularly coated abrasive products. More specifically, the invention concerns the improvement of filled resinous adhesives used in such bond systems, by the inclusion of coupling agent(s) therein.

BACKGROUND OF THE INVENTION

Coated abrasives or abrasive products, sandpaper being a common example, consist of a substrate backing, abrasive grains and a bonding system which operates to hold the abrasive grains to the backing. For a typical coated abrasive product, the backing is coated with a first layer of adhesive, commonly referred to as a "make coat", and then the abrasive grains are applied. The adherence of the resulting adhesive/abrasive combination or composite is then generally solidified (i.e., set) enough to retain the abrasive grains to the backing, so that a second layer of adhesive, commonly referred to as a "size coat", can be applied. The size coat further reinforces the coated abrasive product. Once the size coat is solidified (set), the resulting coated abrasive product can be converted into a variety of convenient forms for various uses, for example sheets, rolls, belts, and discs. Generally, the size coat and make coat may be the same, although they do not necessarily comprise the same adhesive or very similar adhesive compositions. Solvent dilutions to achieve convenient viscosities may differ for them.

The substrate, for typical coated abrasive products, is typically paper, a polymeric film, cloth, a fibre web such as a vulcanized cotton fibre web, a nonwoven web, combinations or composites thereof or treated versions of these. Commonly used abrasive grains include: flint, garnet, emery, silicon carbide, aluminum oxide, ceramic aluminum oxide, alumina zirconia or multi-grain granules. Conventional bond systems typically comprise a glutinous or resinous adhesive, and optionally include a filler. Examples of common adhesives are: hide glue, phenolic, urea-formaldehyde, melamine-formaldehyde, epoxy, varnishes, acrylate resins or combinations thereof.

Fillers are typically inorganic particulate material which has been dispersed within the resin. Fillers operate to inexpensively increase the volume of resin, thus decreasing costs. Also, fillers often make the cured resin harder, more heat resistant and/or less likely to shrink when set. The latter is important, since shrinkage during setting causes considerable stresses in the product. In some instances fillers may also be used as pigments. Fillers are typically of small particle size, are relatively soft by comparison to abrasives, and do not themselves cause much abrasion in use.

Generally fillers comprise materials which are substantially inert, or non-reactive, with respect to the grinding surface; the grinding surface being the surface acted upon by the abrasive product in use. Occasionally, however, active (i.e. reactive) fillers are used. These fillers interact with the grinding surface during use, in beneficial manners.

U.S. Pat. No. 2,322,156 discloses the use of fillers in glutinous and resinous adhesives to improve their hardness, heat resistance, and moisture resistance and to lower their overall cost. The patent refers to typical fillers as being inert, relatively nonabsorbent, nonfibrous, hard, dense, inelastic and nondeformable materials.

U.S. Pat. No. 2,534,805 discloses the use of a laminating adhesive filled with an inert, relatively nonabsorbent, nonfibrous filler. The modified adhesive, according to the patent, is used to laminate two backings together. The addition of filler to the adhesive apparently substantially lowered the rate at which the modified adhesive expanded or contracted, due to changes in humidity.

U.S. Pat. No. 2,873,181 teaches the use of wollastonite, i.e. calcium silicate, as a filler for glue or synthetic resins used in coated abrasives.

The abrasive coating (i.e. abrasive/adhesive composite attached to the substrate) for abrasive products is typically relatively thin, often essentially a monolayer of abrasive particles. The thickness for typical commercial products is often on the order of 0.01–2.0 mm. Thus, even a relatively small, localized failure in the bonding system can easily lead to an exposure of a portion of the substrate, and thus a substantially complete failure of the product, in use. It is noted that coated abrasive products are typically used under conditions of relatively high pressure and temperature; for example at a point of engagement between a coated abrasive belt and a grinding surface. Pressure-generated and/or heat-generated stresses can facilitate failure of the bonding resin to retain the abrasive on the substrate, and thus failure of the product.

Coated abrasives such as sandpaper differ significantly from grinding wheels. For example, grinding wheels are typically formed as a relatively deep or thick (three-dimensional) structure of abrasive grains or particles adhesively retained together in a wheel. A minor failure in adhesive poses relatively little problem, since only an outermost layer of abrasive grains would be affected. That is, a lower, and still effective, layer of abrasive would be exposed. Also, coated abrasive products generally involve a relatively high volume ratio of adhesive to abrasive, by comparison to grinding wheel, and hence greater opportunities for stress to be imparted to the adhesive.

Many coated abrasive products are used or stored in high humidity environments, or are used under a water flood or wash, or are themselves washed between uses. Almost all commonly used resinous adhesives are sensitive to water. Under relatively wet conditions, typically used conventional bond systems substantially weaken. Thus, the coated abrasive product, in some cases, may fail because the bond system has been sufficiently weakened by water that it can no longer hold the abrasive grains or particles to the backing.

Past attempts at improving the performance of bond systems in coated abrasive products have generally focused on improving the bonding interaction between the abrasive and the adhesive. That is, it has generally been believed that failure to obtain good, water resistant chemical adherence between the resin and the mineral has been the problem. The present invention concerns a unique approach to improving coated abrasive products and/or their manufacture, whereby the bonding system is improved by improvement at the resin-filler interface, through use of coupling agent(s).

SUMMARY OF THE INVENTION

The present invention particularly concerns improvements in bonding systems. A particular application concerns bonding systems such as may be used for substrate/bonding system/abrasive products, for example coated abrasives or the like. According to the invention, bonding systems comprising a filler dispersed or suspended in a resin or adhesive material are improved, by improvement of bonding or associative interactions between filler particles and resin polymer. Improvements, according to the present invention, result from affecting either or all of the following, in the advantageous manners described:

1. Reducing viscosity of the resin/filler dispersion. Such a dispersion, during a process of preparing a coated abrasive product, is typically applied as a coating, for example as a make coat or size coat, to the product. Reduced viscosity generally facilitates application.

2. Enhancing suspendability of the filler in the resin, i.e. decreasing the likelihood that suspended or dispersed filler will settle out from the resin/filler suspension during storing or processing to manufacture abrasive articles.

3. Improving product performance due to enhanced operation lifetime, for example through reduced water sensitivity or general overall observed increase in strength and integrity of the bonding system.

The above three "improvements" are effected, according to the present invention, through utilization of a coupling agent in the resin/filler suspension or mixture, in order to improve resin/filler interaction. That is, improvements according to the present invention are effected not directly through improvement of the binder/abrasive interface, but rather through improvements in the resin/filler interactions, generally prior to interaction with the abrasive. This will be better understood from the detailed descriptions below.

Improvements of the above related types, generally result from inclusion of silane-, titanate-, or zircoaluminate-, coupling agent(s) in the resin/filler suspension. Again, the coupling agent apparently acts to improve resin/filler interaction. The results in many instances are reduced viscosity of suspension, improved retention of filler within suspension and/or, improved strength and/or water insensitivity of the bonding system in the overall product. As explained below, a variety of silane-, titanate-, or zircoaluminate-, coupling agents may be used, according to the present invention. While not all coupling agents show improvements in all three recited areas, each generally leads to some improvements in at least one.

Common silane coupling agents are mentioned in the U.S. Pat. Nos. 3,041,156 and 3,098,730. In these patent references, silane coupling agents are reported used to improve binder/abrasive interactions, in particular in grinding wheels or the like. In U.S. Pat. No. 2,873,181 coupling agents are mentioned as improving binder/abrasive interactions in grinding wheels and coated abrasives. A silane coupling agent is also mentioned in British Patent No. 1,334,920, for use with a filler material in a grinding wheel.

Generally, according to the present invention, the coupling agent is added to the bonding system via one of two methods: either through pretreatment, i.e. addition to the filler prior to incorporation of the filler into the resin adhesive; or, "in situ", whereby the coupling agent is mixed in the adhesive prior, during or after the filler has been added thereto. A mere 0.1% of coupling agent, based on filler weight, can provide substantial improvement in the bonding system, as will be understood from the detailed descriptions.

DETAILED DESCRIPTION OF THE INVENTION

As required, detailed embodiments of the present invention are disclosed herein. It is to be understood, however, that the disclosed embodiments are merely exemplary of the invention, which may be embodied in various forms. Therefore, specific chemical, compositional, and process details disclosed herein are not to be determined as limiting, but rather as a basis for the claims and as a representative basis for teaching one skilled in the art to variously employ the present invention in virtually any appropriately detailed manner or arrangement.

The Bonding Agent

Generally, coated abrasive articles according to the present invention comprise substrate, bonding agent and abrasive. Typically, as previously described, a make coat of the bonding agent is applied to the substrate, in order to provide a relatively thin adhesive surface for the abrasive, which is next applied. The make coat/abrasive composite is typically sufficiently set to provide for significant adherence of the abrasive material, during later processing. Finally, a size coat, and/or a final coat, of the bonding agent is typically applied over the resultant substrate/bonding agent/abrasive composite. A final step of overall cure or set, results in abrasive products of interest to the present invention. A typical thickness for the composite of abrasive and adhesive bond system is about 0.01–2.0 mm.

The bonding agent of preferred embodiments of the present invention generally comprises a mixture, dispersion or suspension of coupling agent, adhesive, and filler. These components may be as follows:

The Coupling Agent

Coupling agents typically operate through two different reactive functionalities, an organofunctional moiety and an inorganic functional moiety. When a coated abrasive bond system (i.e. adhesive/filler mixture) is modified with a coupling agent, the organofunctional group of the coupling agent becomes bonded to, or otherwise attracted to or associated with, the adhesive/resin matrix, as the adhesive polymerizes. The inorganic functional moiety appears to generate bonding or similar association with the dispersed inorganic filler. Thus, the coupling agent acts as a bridge between the organic resinous adhesive and the inorganic filler, i.e. at the adhesive/filler interface. In various systems this results in:

1. Improvement in retention of dispersed filler within the resin; i.e. the filler is less likely to settle out of the resin/filler dispersion during processing;
2. Reduction in resin/filler viscosity; and/or,
3. Improvement in final product performance; i.e. lifetime, water insensitivity etc.

Herein, the term "coupling agent" will be meant to include mixtures of coupling agents, and the terms "resin", "adhesive" or variants thereof, will be understood to include reference to mixtures. That is, resins and/or coupling agents used in bonding systems according to the present invention may comprise mixtures. Further, the term "filler" as used is generally meant to include reference to mixtures.

There are three major types of coupling agents of particular interest herein: silanes, titanates, and zircoaluminates. Silanes are by far the most readily available and widely studied. Useable silane coupling agents generally correspond to the formula: $X_3SiR^1Y$, wherein:

$R^1$ is an alkyl group,

Y is an organofuctional group; and,

X is a hydrolyzable group.

Silane coupling agents are discussed in U.S. Pat. No. 3,079,361; incorporated herein by reference. The organofuctional group (Y) may be any of a variety of groups which can react with the resinous adhesive during curing, or which are otherwise sufficiently compatible with the resinous adhesive to form an bonding-like association therewith. Organofuctional groups useable as Y include: amino-, epoxy-, vinyl-, methacryloxy-, mercapto-, ureido- and methacrylate- groups. Examples of silane coupling agents are described in Plueddmann, *Silane Coupling Agents,* Plemum Press, New York (1982), incorporated herein by reference. Amino silanes are generally preferred coupling agent(s) for use in improving bond systems according to the present invention.

The exact nature of the bonding or association between the hydrolyzable group (X) and the inorganic filler is not fully understood, and may differ for various fillers. For fillers that contain silica, it may be theorized that an Si—O—Si linkage occurs, via reaction of the hydrolyzable group from the coupling agent with a hydroxy-group on the inorganic filler surface. It will be understood that the particular nature of the associative interaction is not critical, to the invention, and it is not intended that the present invention be limited to any particular theory, or type, of interaction. It is noted, however, that the nature of the associative interaction will tend to affect performance and processing.

The hydrolyzable group(s) on the silane can be any of a variety of hydrolyzable groups. The term "hydrolyzable group" and variants thereof, is meant to refer, for example, to any moiety which may be bonded to silicon through a silicon-halogen bond, a silicon-oxygen bond, a silicon-nitrogen bond or a silicon-sulfur bond. Specific examples of hydrolyzable silanes are those in which X is: a halogen, such as chlorine, bromine, or iodine; —OR, where R is a monovalent hydrocarbon or a monovalent halohydrocarbon radical such as a methyl-, ethyl-, octadecyl-, vinyl-, allyl-, hexenyl-, cyclohexyl-, cyclopentyl-, phenyl-, tolyl-, xylyl-, benzyl-, chloroethyl-, trifluoropropyl-, chlorophenyl-, bromocyclohexyl-, iodonaphthyl-, or chlorovinyl-group; —OR where R is a hydroxyhydrocarbon radical such as betahydroxyethyl-, beta-hydroxypropyl-, omega-hydroxyoctandecyl-, para-hydroxyphenyl-, hydroxycyclohexyl or beta-gamma dihydroxypropyl-; —OR where R is an etherated hydrocarbon or halohydrocarbon radical having the formula $OR^2(OR^2)_zOW$, where $R^2$ is hydrocarbon or halohydrocarbon and W is hydrocarbon or H, such as those derived from polyethylene glycols or polypropylene glycols and their monohydrocarbon ethers, and in which z is an integer such as 1, 2, 5, 8 or 10 or, those derived from halogenated glycols such as chloropropylene glycol; or, amino radicals in which the nitrogen is bonded to the silicon, for example as dimethylamino-, methylamino- compounds; and sulfonated radicals containing the Si—S bond such as —SH or —SR compounds, where R is a monovalent organic radical such as a methyl-, ethyl-, or chlorobutyl- group, etc.

There is no requirement that all groups X in $X_3SiR^1Y$ compounds be the same. Further, mixtures of coupling agents may be used. The silane can be a monomeric material, that is a silane in which all groups X are monovalent radicals; or the silane may be a polymeric material, that is a silane in which at least one group X is a polyvalent radical. Thus, for example, the silane can be in form of a silazane in which the silicons are bonded through nitrogen atoms and each silicon has one beta-(vinylphenyl)ethyl group attached thereto. The silanes can also be polysilthienes in which the silicons are bonded through sulfur atoms and each silicon has a beta-(vinylphenyl)ethyl radical attached thereto.

When, according to the present invention, a silane coupling agent is used in a resin/filler system (i.e. a bonding system), generally improvements in all three of: retention of dispersed filler in resin, reduction in resin/filler viscosity, and final abrasive product strength and performance, particularly from decreased water sensitivity, are observed. Thus, silane coupling agents generally improve both final product performance and product manufacturing processes.

A second class of coupling agent usable according to the present invention comprises titanates, which are described generally by the formula:

$$(RO)_m—Ti—(OXR^1Y)_n$$

Generally, an (RO) group will couple to the filler, and an $(OXR^1Y)$ group couples to the organic resin. For typical applications: R is a hydrocarbyl radical or a hydrocarbyl radical substituted with inert substituents such as a halogen, oxygen, sulfur, and phosphorous. Preferably R is a $C_1$- to $C_{10}$- hydrocarbyl radical, preferably an alkyl- or alkenyl-radical, and most preferably R is a $C_1$ to $C_4$ alkyl- radical such as methyl- or isopropyl-radical; X is an organic binder functional group and is selected such that it becomes a permanent part of the polymer network after the resinous adhesive is set. For example, X is preferably a divalent phosphato-, pyrophosphato-, or sulfyl-group; $R^1$ is a thermoplastic functional group selected such that it is compatible with thermoplastic resins or thermosetting resins. $R^1$ typically includes a long carbon chain which provides for Van der Waals entanglements. Preferably $R^1$ is a hydrocarbyl radical or a hydrocarbyl radical substituted with an inert substituent such as those listed above inert substituents, e.g., a $C_1$ to $C_{100}$ alkylene radical; Y is a thermoset functional group selected such that it becomes a permanent part of the polymer network after the resinous adhesive polymerizes. Y typically contains methacrylate or amine and $m+n \leqq 7$. Preferably m is 1 and n is 5. It is also noted that R,$R^1$,Y and X can each represent a plurality of different radicals in the same titanate coupling agent. The above coupling agents may terminate at the end of the R or $R^1$ groups with a reactive radical such as an acrylate, methacrylate or vinyl radical.

Usable titanate coupling agents are identified in U.S. Pat. No. 4,473,671, incorporated herein by reference. Specific examples of the above include: isopropyl triisostearoyl titanate, isopropyl tri(lauryl-myristyl) titanate, isopropyl isostearoyl dimethacryl titanate; isopropyl tri(dodecyl-benzenesulfonyl) titanate, isopropyl isostearoyl diacryl titanate, isopropyl tri(diisooctyl phosphato) tri(dioctylpyrophosphato) titanate; and isopropyl triacroyl titanate.

When, according to the present invention, a titanate coupling agent is used in a resin/filler system, generally improvements have been observed to occur with respect to retention of filler in the resin/filler mixture or dispersion. Also, as will be understood from the detailed examples reported below, improvements in viscosity are also observed.

A third class of coupling agent useable according to the present invention comprises zircoaluminates, which are described generally by the formula $$[Al_2(OR^1O)_aA_bB_c]_x[OC(R^2)O]_y[ZrA_dB_e]_z$$

Such compounds are discussed in U.S. Pat. No. 4,539,048; incorporated herein by reference. In general: the $[Al_2(OR^1O)_aA_bB_c]$ groups are chelated aluminum moieties, the $[OC(R^2)O]$ group is an organofunctional ligand, and the $[ZrA_dB_e]$ groups are zirconium oxyhalide moieties Typically, the organofunctional ligand is complexed with, and is chemically bound to, the chelated aluminum moiety and the zirconium moiety.

For the aluminum moiety,

A and B are preferably independently: hydroxy groups or a halogen, a, b, and c are preferably numerical values such that $2a+b+c=6$, $(OR^1O)$ is an alpha, beta- or alpha, gamma- glycol group in which $R^1$ is an alkyl-, alkenyl-, or alkynyl-group having one to six carbon atoms, preferably having 2-3 carbon atoms, or $(OR^1O)$ is an alpha-hydroxy carboxylic acid residue according to the formula:

$$OCH(R^3)COOH$$

Wherein $R^3$ is H or an alkyl group having from 1 to 4 carbon atoms; $R^3$ preferably being —H or —$CH_3$.

For the organofunctional moieties, —$OC(R^2)O$—, each $R^2$ is preferably: an alkyl-, alkenyl-, alkynyl- or arylalkyl- carboxylic acid having from 2 to 18 carbon atoms, and preferably from 2 to 6 carbon atoms; an amino functional carboxylic acid having from 2 to 18, and preferably from 2 to 6 carbon atoms; a dibasic carboxylic acid having from 2 to 18, and more preferably from 2 to 6 carbon atoms; an acid anhydride of a dibasic acid having from 2 to 6 carbon atoms, most preferably wherein both carboxy groups are terminal; a mercapto functional carboxylic acid having from 2 to 18 carbon atoms, and preferably from 2 to 6 carbon atoms; an epoxy functional carboxylic acid having from 2 to 18 and preferably 2 to 6 carbon atoms; or, an acid anhydride of a dibasic acid having from 2 to 18, and preferably 2 to 6 carbon atoms.

An extensive variety of —$OC(R^2)O$— anionic ligands are known and usable. Examples of specific dibasic anions are: oxalic, malonic, succinic, glutonic, adipic, tartaric, itaconic, maleic, fumaric, phthalic and terephthalic anions. Examples of specific aminofunctional carboxylate anions include the anions of: glycine, alanine, beta-alanine, valine, leucine, isoleucine, phenylalanine, tyrosine, serine, threonine, methionine, cysteine, cystine, proline, hydroxyproline, and, aspartic and glutaric acids. Examples of specific useful monobasic carboxylic acid moieties include the anions of the following carboxylic acids: acetic, propionic, butyric, pentanoic, hexanoic, heptanoic, octanoic, dodecanoic, myristic, palmitic, stearic, isostearic, propenoic, 2-methylpropenoic, butenoic, hexenoic, benzoic, and cinnamic.

For the zirconium oxyhalide moiety preferably:

A and B are hydroxy groups or halogens; d and e are numerical values such that $d+e=4$; the molar ratio of chelated aluminum moiety to zirconium oxyhalide moiety is from about 1.5 to 10; the molar ratio of organofunctional ligand to total metal is from about 0.05 to 2, and preferably about 0.1 to 0.5; and x, y, and z are each at least one.

It has been theorized, see U.S. Pat. No. 4,539,048, that the reaction of the aluminum zirconium metallo-organic agent is by reaction between the pendant hydroxy or other groups of both aluminum and zirconium metal centers and hydroxyl groups on the inorganic particulate's surface and/or surface adsorbed molecules of water. The organofunctional moiety is selected so that it reacts with the resinous adhesive during the cure or it is at least compatible for associative interaction with the resinous adhesive. The organofunctional moiety generally becomes a permanent part of the resinous matrix when the resinous adhesive polymerizes.

Resin/filler mixtures improved with zircoaluminates according to the present invention generally show reduced viscosity, enhanced retention of filler in dispersion or suspension, and, improved grinding performance. This is illustrated in the below described examples.

The Adhesive Component of the Adhesive/Component Mixture

The resinous adhesive can be any resin that satisfies the performance requirements of a coated abrasive. Examples of such resins that typically are used are: phenolics, urea-formaldehyde, melamine-formaldehyde, epoxies, acrylates, urethanes, polyisocyanates, polyesters or combinations or mixtures thereof.

The Filler Component of the Adhesive/Filler Mixture

Inorganic fillers which are useful in the invention include: common mineral fillers, the inorganic compounds of silicon, and metal oxides, such as the oxides of zinc, aluminum, iron, copper or titanium. Examples of these fillers include: quartz and other forms of silica such as silica gel, ground glass, glass fibers, glass spheres and glass beads or combinations thereof. Other fillers include: calcium metasilicate, aluminum silicate, dolomite, titanium dioxide, diatomaceous earth, sand, asbestos, mica, alumina trihydrate, corundum, clay, iron oxide, feldspar, talc, roofing granules, calcium carbonate, or combinations thereof. The preferred filler of the invention is calcium metasilicate, known also as wollastonite.

The filler size, measured in terms of its average diameter, for use in adhesive/filler mixtures according to the present invention can range from submicron sizes up to about 90 microns (micrometers). The preferred range is about 2 microns to 28 microns. Filler particles of less than about 2 microns are generally not used in coated abrasive bond systems, since such small particles, when dispersed in adhesives in the quantities required to produce a good, filled, bond system, do not produce a readily coatable adhesive or an adhesive that flows properly during the coating operation and especially during the sizing operation.

As previously discussed, an advantage of using the coupling agent, for bonding or similar interaction between the filler and resinous adhesive, is that it generally results in a lower viscosity bond system. Consequently, small particle size fillers such as 2 to 5 microns can be employed while maintaining a suitable coating viscosity. If a coupling agent is not used, it is generally difficult to coat bond systems that contain 2 to 5 micron size fillers.

When heavier or more viscous bond systems are involved, and when relatively coarse grit-coated abrasives are being coated, larger particle sizes of fillers can be used. It will be understood that fillers should have particle diameters substantially less than the diameter of the abrasive grains to be coated, usually less than one-fourth the diameter of the abrasive grains. It is generally not recommended that fillers with most of the particles of about the same size be used, rather a filler with variable particle sizes is preferred, so that the smaller particles in the solidified bond systems partially fill the spaces between the larger particles of filler. The wider the distribution, the better the filler particles appear to pack in the solidified bond system. As a consequence, higher percentages of filler can typically be used in the bond system, when a range of particle sizes is involved.

The range of filler used in the bond system can vary greatly, generally depending upon the end application of the coated abrasive and the grit size. Typically, the amount of filler in the bonding system can be anywhere from 1 volume percent to 65 volume percent. The preferred range for most applications is about 30 to 60 volume percent of the bonding system.

In general, the low end of the percent filler is the minimum amount of filler that, together with the coupling agent and resinous adhesive, will make a bond system that has sufficient hardness, heat resistance, moisture resistance and strength required for satisfactory coated abrasive products. The high end of the percent filler is the maximum amount of filler that, together with the coupling agent and resinous adhesive, will produce a readily coatable adhesive or an adhesive that flows properly during the coating operation and especially during the sizing operation. With fine grade abrasives (abrasive grains), a low viscosity size bond system is required so that the bonding agent can flow in between small abrasive grains. That is, finer filler sizes are desirable so that the bonding agent does not merely lay on top of the abrasive grains. With coarse grade abrasives, a high viscosity bond system can be tolerated since the abrasive grains are larger. In general, for bond systems of the fine grade abrasive products, it is preferred to use a lower percent filler than the bond systems of the coarse grade products.

The shape of the inorganic filler influences the viscosity and physical properties of the bond system. For example, cubical or spherical filler particles do not increase the viscosity of the bond system as much as fibrous filler particles do. The cubical- or spherical-shaped filler particles also pack more densely in the adhesive, which reduces the viscosity. However, fibrous fillers increase the physical strength, i.e. tensile strength, of the bond system more than spherical fillers do.

The filler type, size, amount, and filler shape all have a significant effect on the bond system coating viscosity. It is an advantage of this invention that the addition of a coupling agent in general tends to reduce the coating viscosity because of its bridging effect between the resinous adhesive and the inorganic filler. This reduction in viscosity allows more leeway in selecting filler type, size, amount, shape or combinations thereof, than if the bond system did not have any coupling agent. However, the combination of filler type, size, amount, and shape should be balanced in order to produce a bond system that is readily coatable and flows properly during the coating operation.

Preparation of the Improved Adhesive/Filler Mixture, Including Coupling Agent Therein A preferred method of adding the coupling agent to the bond system is by pretreatment; that is, by treating the filler first with the coupling agent and then adding the treated filler to the resinous adhesive, to form the bond system. In a pretreatment process, an appropriate solvent is added to the coupling agent to form a relatively low viscosity solution This solution is applied to the inorganic filler by methods such as mixing, spraying, dipping, atomizing or brushing. Heat is typically applied during the process, or after the process, to remove the solvent and other volatile materials.

Another method of adding the coupling agent to the bond system is through an in situ treatment. For this method, the coupling agent is mixed into the adhesive prior, during or after the filler is added to the resinous adhesive. According to this method, the coupling agent is added to the bond system prior to the bond system being coated onto the substrate as a make coat or size coat.

A variety of substrates may be utilized in articles according to the present invention for typical commercial applications, polyester substrates and vulcanized cotton fibre backings being particularly useful.

Coupling agents, according to the present invention, may be utilized to improve the resin/filler mixture of either the size coat or make coat, or both. Best results appear to involve inclusion in both the size coat and the make coat, and generally the same adhesive/filler mixture is used in both.

The amount of the coupling agent that is added to the bond system may be relatively small. In general, a mere 0.1% coupling agent by weight, based on the filler weight, is observed to produce an improved bond system for coated abrasive applications, and even lower amounts may be useful. The preferred range of coupling agent is about 0.1% to 1%, by weight, based on the filler weight, though quantities in excess of that range may be used.

The above-described bond system, as modified with a coupling agent, may be used in a variety of applications; for example as a treatment for coated abrasive backings and as a bond system for three-dimensional non-woven abrasives.

The following examples will further illustrate the invention.

EXAMPLES

Examples 1 and 2 exemplify the abrasive performance difference between an abrasive bond system containing a filler modified with a coupling agent and an abrasive bond system containing just a filler, under wet grinding conditions. Generally, improvement in article operation is considered to be an increase of at least about 5% in the amount of steel removed by an abrasive article involving an improved (i.e. coupling agent containing) resin/filler composition, relative to an unimproved article.

EXAMPLE 1

The coated abrasive backing used was a Y weight woven polyester cloth with a four over one weave. The backing was saturated with a latex/phenolic resin and then placed in an oven to partially cure the resin. Next, a latex/phenolic resin and calcium carbonate coating composition was applied to the backside of the backing and also heated to partially cure the resin. Finally, a latex/phenolic resin was applied to the coat side or front side of the cloth and heated to partially cure the resin. The backing was completely treated and was ready to receive the make coat. A make coat bond system was prepared that consisted of 66% by volume a resole phenolic resin, 34% by volume calcium metasilicate and 1% by weight, based upon the filler weight, of an amino silane coupling agent. The calcium metasilicate was obtained from NYCO Company, under the tradename NYAD® 400 wollastonite. The amino silane was obtained from Union Carbide, under product number A1100; which is a gamma-aminopropyl triethoxysilane. The amino silane was added to the phenolic resin during the bond system mixing. A solvent (90/10 ratio of water to ethyl Cellosolve, i.e. $[C_2H_5O(CH_2)_2OH]$ was added to the bond system to form an 84% solids make coat solution. Ethyl Cellosolve/water was the solvent used in all examples reported herein. The make coat solution was applied to the backing with an average wet weight of 196 grams/square meter. Immediately thereafter, grade 50 alumina zirconia mineral was applied, in an average amount, by weight, of 600 grams/square meter. The substrate/mineral composite was pre-cured for 90 minutes in an oven set at 88° C. Next, a size coat was applied, at an average wet weight of 270 grams/square meter. The size bond system was the same as the make bond system except that a 78% solids solution was used. After size coating, the coated abrasive material received a pre-cure of 90 minutes at 88° C. and then a final cure of 10 hours at 100° C. The coated abrasive material was flexed and attached to the periphery of a 14 inch (36 cm.) metal wheel. The effective cutting area of the abrasive segment was 2.54 cm by 109 cm. The workpiece abraded by these segments was 1018 steel, 1.27 cm width by 36 cm length by 7.6 cm height. Abrading was conducted along the 1.27 cm by 36 cm face. The metal wheel speed was 1500 rpm or 1674 surface meters per minute. The tablespeed, at which the workpiece traversed, was 20 meters/minute. The downfeed increment of the wheel was 0.0040 cm/pass of the workpiece. The process used was a conventional surface grinding wherein the workplace was reciprocated beneath the rotating contact wheel with incremental downfeeding between each pass. This process was used for all reported examples, except where indicated. The grinding was done under a water flood. The cut data is reported below in Table I.

EXAMPLE 2

Example 2 was made and tested in the same manner as Example 1, except the bond system consisted of 66% by volume a resole phenolic and 34% by volume calcium metasilicate. The calcium metasilicate was the same as Example 1. A coupling agent was not added to the bond system in this example.

TABLE I

Comparison of Amino Silane Modified Calcium Metasilicate Versus Nontreated Calcium Metasilicate.

| Example | Cut Performance, $cm^3$ of 1018 Steel Removed |
|---|---|
| 1 (with Coupling Agent) | 158 |

TABLE I-continued

Comparison of Amino Silane Modified Calcium Metasilicate Versus Nontreated Calcium Metasilicate.

| Example | Cut Performance, $cm^3$ of 1018 Steel Removed |
|---|---|
| 2 (without Coupling Agent) | 114 |

As seen from this data, a 39% performance increase was achieved during wet grinding when a coupling agent for the resin/filler dispersion was used in the abrasive bond, i.e. as part of the resin/filler mixture.

Examples 3 and 4 compare abrasive product segments containing a filler modified with a coupling agent in the bond system to abrasive product segments containing just a filler in the bond system, under dry grinding conditions.

EXAMPLE 3

The coated abrasive segment for Example 3 was made in the identical manner as Example 1, except a different bond system was used. The bond system for the make and size coats consisted of 66% by volume a resole phenolic resin and 34% by volume an amino silane treated calcium metasilicate filler. The filler was obtained from NYCO Company, under the tradename 325 Wollastokup® 10014. To obtain desired coating viscosities, the make bond system was diluted to 84% solids and the size bond system was diluted to 78% solids. The workpiece abraded by this segment was 1018 steel, 1.27 cm width by 36 cm length by 7.6 cm height. The metal wheel speed was 1500 rpm or 1674 surface meters per minute. The tablespeed, at which the workpiece traversed, was 24 meters/minute. The downfeed increment of the wheel was 0.005 cm/pass of the workpiece. The cut data of this abrasive segment is reported below in Table II.

EXAMPLE 4

The coated abrasive segment for Example 4 was made in the identical manner as Example 3 except the filler was not treated with coupling agent. The filler was obtained from NYCO company under the tradename NYAD® 325 Wollastonite. The testing of Example 4 was done under the same conditions as Example 3.

TABLE II

Comparison of Silane Treated Filler Versus Untreated Filler, Under Dry Conditions

| Example | Grinding Performance, $cm^3$ of 1018 Steel Removed |
|---|---|
| 3 (Amino Silane Treated Filler) | 227 |
| 4 (Untreated Filler) | 228 |

There was essentially no performance difference under dry grinding conditions between the amino silane treated filler segment and the untreated filler segment. However, viscosity and suspension improvements in the resin/filler mixture were observed.

Examples 5, 6, 7, and 8 compare abrasive performance after storage under different relative humidities.

EXAMPLE 5

A make adhesive was prepared using 66% by volume a resole phenolic resin and 34% by volume amino silane treated quartz filler. The filler was obtained from Illinois Mineral Company, as 1240 H quartz. The make coat was diluted to 84% solids and applied to the polyester backing described in Example 1 with an average wet weight of 196 grams/square meter. Immediately thereafter, grade 50 alumina zirconia mineral was applied, at an average weight of 600 grams/square meter. This article was precured for 90 minutes in an oven set at 88° C. Next, the size coat was applied at an average wet weight of 270 grams/square meter. The size bond system was the same as the make bond system, except a 78% solids solution was used. After the size coating, the coated abrasive material received a pre-cure of 90 minutes at 88° C. and then a final cure of 10 hours at 100° C. The coated abrasive material was flexed and attached to the periphery of a metal wheel. The effective cutting area of the abrasive segment was 2.54 cm by 109 cm. The workpiece being abraded by these segments was 1018 steel, 1.27 cm width by 36 cm length by 5.1 cm height. The metal wheel speed was 1500 rpm or 1674 surface meters per minute. The tablespeed at which the workpiece traversed was 24 meters/minute. The downfeed increment of the wheel was 0.0053 cm/pass of the workpiece. The abrasive segments were stored at 35% relative humidity for two weeks prior to testing. The cut data is reported below in Table III.

EXAMPLE 6

Abrasive segments for Example 6 were made and tested in the same manner as Example 5 except, the segments for Example 6 were stored at 90% relative humidity for two weeks, prior to testing.

EXAMPLE 7

Abrasive segments for Example 7 were made and tested in the same manner as Example 5 except the filler was untreated; i.e. no coupling agent was used. The filler used was 1240 quartz obtained from Illinois Mineral Company.

EXAMPLE 8

Abrasive segments for Example 8 were made and tested in the same manner as Example 7, except the segments for Example 8 were stored at 90% relative humidity for two weeks prior to testing.

TABLE III

Comparison of Amino Silane Treated Filler Versus Nonsilane Treated Filler After Storage Under Different Humidities

| Example | % Relative Humidity of Storage | Cut Performance, $cm^3$ of 1018 Steel Removed |
|---|---|---|
| 5 (Amino Silane Treated Filler) | 35 | 43 |
| 6 (Amino Silane Treated Filler) | 90 | 28 |
| 7 (No Filler Treatment) | 35 | 47 |
| 8 (No Filler Treatment) | 90 | 14 |

There was not a significantly large performance difference between the abrasive segments containing an amino silane coupling agent and those segments without a coupling agent, after storage at 35% humidity for only two weeks. However, after storage under the high humidity conditions, the segments containing an amino silane coupling agent had two times the abrasive performance by comparison to segments containing no coupling agent. Thus, atmospheric humidity can deleteriously effect bonding system performance, and coupling agents can improve this.

Examples 9 and 10 compare two different coupling agents. In Example 9 an amino silane was used. In Example 10 an epoxy silane was used.

EXAMPLE 9

The abrasive segment for Example 9 was made in the same way as Example 1 except different make and size bond systems were used. The make and size bond systems consisted of 66% by volume a resole phenolic resin and 34% by volume amino silane treated calcium metasilicate filler. This filler was obtained from NYCO Company, under the name 1250 Wollastokup® 10014. In order to obtain proper coating viscosities, the make bond system was diluted to 84% solids and the size bond system was diluted to 78% solids. The coated abrasive material was flexed and attached to the periphery of a metal wheel. The effective cutting area of the abrasive segment was 2.54 cm by 109 cm. The workpiece abraded by these segments was 1018 steel, 1.27 cm width by 36 cm length by 7.6 cm height. The metal wheel speed was 1500 rpm or 1674 surface meters per minute. The grinding was done under a water flood. The speed at which the workpiece traversed was 19.8 meters/minute. The downfeed increment of the wheel was 0.0038 cm/pass of the workpiece. The cut data is reported in Table IV.

EXAMPLE 10

Example 10 was made and tested under the same methods as Example 9 except the filler was pretreated with an epoxy silane coupling agent. The filler used in Example 10 was obtained from the NYCO Company, under the name 1250 Wollastokup® 10224.

TABLE IV

Comparisons of Different Coupling Agents.

| Example | Coupling Agent | Cut Performance, $cm^3$ of 1018 Steel Removed |
|---|---|---|
| 9 | Amino Silane | 148 |
| 10 | Epoxy Silane | 140 |

A good abrasive performing segment can be achieved with either an amino silane or an epoxy silane coupling agent.

Examples 11 through 17 compare grinding from abrasive segments made with different percent volumes of filler in the bond system.

EXAMPLE 11

The backing employed in this example was the same as in Example 1. The make coat bond system was 76% solids solution of a resole phenolic resin. For this example, no inorganic filler was added to the bond system. The make bond system was coated onto the backing and immediately thereafter grade 50 alumina zirconia mineral was applied. The article was pre-cured for 90 minutes at 88° C. Next, a 76% solids solution of the same resole phenolic used in the make bond system was applied to the product as a size coat. The coated abrasive product received a pre-cure of 90 minutes at 88° C. and then a final cure of 10 hours at 100° C. The make coat, mineral and size coat weights are reported in Table 5. The make and size coat weights are the "wet" weights The coated abrasive material was flexed and attached to the periphery of a metal wheel. The effective cutting area of the abrasive segment was 2.54 cm by 109 cm. The workpiece abraded and the wheel speed were the same as Example 1. All grinding was done under water flood. The speed at which the workpiece traversed was 20 meters/minute. The downfeed increment of the wheel was 0.0038 cm/pass of the workpiece. The cut data is reported in Table V.

EXAMPLE 12

Example 12 was prepared and tested in the same manner as Example 11, except for Example 12 a different make and size bond system was used. The make and size bond system comprised 5 percent by volume calcium metasilicate and 95 percent by volume a resole phenolic resin. The calcium metasilicate was obtained from NYCO Company under the name 400 Wollastokup ® 10014. This filler was pretreated with an amino silane coupling agent. The make coat was 75% solids and the size coat was diluted to 78% solids.

EXAMPLE 13

Example 13 was prepared and tested in the same manner as Example 12, except a different filler to resin ratio was used. The make and size bond system comprised 17% by volume calcium metasilicate and 83% by volume a resole phenolic resin. The make bond system was 80% solids.

EXAMPLE 14

Example 14 was prepared and tested in the same manner as Example 12, except a different filler to resin ratio was used. The make and size bond system comprised 34% by volume calcium metasilicate and 66% by volume a resole phenolic resin. The make bond system was 84% solids.

EXAMPLE 15

Example 15 was prepared and tested in the same manner as Example 12, except a different filler to resin ratio was used. The make and size bond system comprised 50% by volume calcium metasilicate and 50% by volume a resole phenolic resin. The make bond system was 84% solids.

EXAMPLE 16

Example 16 was prepared and tested in the same manner as Example 12, except a different filler to resin ratio was used. The make and size bond system comprised 59% by volume calcium metasilicate and 41% by volume a resole phenolic resin. The make bond system was 84% solids.

EXAMPLE 17

Example 13 was prepared and tested in the same manner as Example 12, except a different filler to resin ratio was used. The make and size bond system comprised 65% by volume calcium metasilicate and 35% by volume a resole phenolic resin. The make bond system was 76% solids.

TABLE V

Comparison of Different Filler Volumes.

| Example | Filler Volume | Resin Volume | Coating Weights grams/square meter Make | Mineral | Size | Cut Performance $cm^3$ of 1018 Steel Removed |
|---|---|---|---|---|---|---|
| 11 | 0 | 100 | 180 | 600 | 215 | 33.3 |
| 12 | 5 | 95 | 149 | 600 | 309 | 38.1 |
| 13 | 17 | 83 | 195 | 600 | 281 | 86.5 |
| 14 | 34 | 66 | 215 | 600 | 293 | 158 |
| 15 | 50 | 50 | 215 | 600 | 328 | 195 |

TABLE V-continued

Comparison of Different Filler Volumes.

| Example | Filler Volume | Resin Volume | Coating Weights grams/square meter Make | Mineral | Size | Cut Performance $cm^3$ of 1018 Steel Removed |
|---|---|---|---|---|---|---|
| 16 | 59 | 41 | 258 | 600 | 371 | 185 |
| 17 | 65 | 35 | 297 | 600 | 379 | 26.5 |

Note: The make and size weights were adjusted so that the volume of the bond system was approximately the same in each example.

It can be seen from the above data that the preferred range of filler is between 30 to 60% by volume of the bond system.

Examples 18 through 23 report effects of different amounts of coupling agents added to the make and size bond systems.

EXAMPLE 18

A make and size bond system was prepared that comprised 34% by volume calcium metasilicate and 66% by volume a resole phenolic resin. A coupling agent was not added to the bond system in this example. The filler was obtained from NYCO Company, under the name NYAD ® 400 wollastonite. Using this make and size bond system, the coated abrasive product was prepared in a similar manner as Example 1. Then the product was flexed and tested under the same conditions as Example 1. The grinding results are reported in Table VI.

EXAMPLE 19

The coated abrasive segment of Example 19 was produced and tested in the same manner as Example 18 except a 0.1% by weight based on the filler weight of an amino silane coupling agent was added to the make and size bond systems. The coupling agent was obtained from Union Carbide, under product number A1100.

EXAMPLE 20

Example 20 was the same as Example 19 except the weight percent of amino silane coupling agent was 0.5%.

EXAMPLE 21

Example 21 was the same as Example 19 except the weight percent of amino silane coupling agent was 1%.

EXAMPLE 22

Example 23 was the same as Example 19 except the percent coupling agent was 5% and the size weight was 250 grams/square meter.

EXAMPLE 23

Example 22 was the same as Example 19 except the percent coupling agent was 25% and the size weight was 235 grams/square meter.

TABLE VI

Comparison of Different Percent Coupling Agent.

| Example | % Coupling Agent | Cut, $cm^3$ of 1018 Steel Removed |
|---|---|---|
| 18 | 0 | 114 |
| 19 | 0.1 | 158 |
| 20 | 0.5 | 155 |
| 21 | 1 | 158 |
| 22 | 5 | 126 |
| 23 | 25 | 121 |

It can be seen from this data that the preferred range of coupling agent is between 0.1% to 1% based upon the filler weight.

Examples 24 and 25 exemplify that there is not a significant difference introduced in grinding performance by variation in the manner in which the coupling agent is applied.

EXAMPLE 24

For this example, the filler was pretreated with an amino silane coupling agent prior to the filler being added to the resinous adhesive. The coated abrasive segment was prepared according to the method described in Example 14. The workpiece abraded and the metal wheel speed were the same as Example 1. The grinding was done under a water flood. The tablespeed at which the workpiece traversed was 24 meters/minute and the downfeed increment of the wheel was 0.0042 cm/pass of the workpiece. The cut data of this abrasive segment can be found in Table VII.

EXAMPLE 25

For this example, the amino silane coupling agent was added in situ, during the mixing of the organic resinous adhesive and the inorganic filler. The coated abrasive segment was made in the manner as described in Example 21. The grinding was performed under the same conditions as Example 24.

TABLE VII

Comparison of Different Methods of Applying the Coupling Agent

| Example | Method of Applying | Cut Performance, $cm^3$ of 1018 Steel Removed |
|---|---|---|
| 24 | Pretreatment | 209 |
| 25 | In Situ | 214 |

These abrasive cut numbers were within experimental error of each other, so there was no significant performance difference observed. Examples 26 and 27 compare grinding performance from abrasive segments using calcium carbonate filler in the bond system with an optional amino silane coupling agent. The amino silane coupling agent does not bond to the calcium carbonate, since calcium carbonate does not have a hydrolyzable surface. Thus, the Examples illustrate whether coupling agent/abrasive interactions are significant.

EXAMPLE 26

This example describes a coated abrasive segment using a calcium carbonate filler without a coupling agent in the bond system.

The backing employed in this example was the same as in Example I. A make bond system was prepared that comprised 52% by weight calcium carbonate filler (average particle size of 15 microns), and 48% by weight a resole phenolic resin. A solvent was added to the bond system to form an 84% solids make coat solution This was applied to the backing at an average wet weight of 196 grams/square meter. Immediately thereafter, grade 50 alumina zirconia mineral was applied, at an average weight of 600 grams/square meter. The resulting composite was pre-cured for 120 minutes in an oven set at 88° C. Next, the size coat was applied with an average wet weight of 270 grams/$m^2$. The size bond system was the same as the make bond system, except a 78% solids solution was used. After size coating, the coated abrasive material received a pre-cure of 120 minutes at 88%. It was then subjected to a final cure of 10 hours at 100° C. The coated abrasive material was flexed and attached to the periphery of a metal wheel. The effective cutting area of the abrasive segment was 2.54 cm by 109 cm. The workpiece abraded by these segments was 1018 steel, 1.27 cm width by 36 cm length by 7.6 cm height. The metal wheel speed was 1500 rpm or 1674 surface meters per minute. The table speed at which the workpiece traversed was 24 meters/minute. The downfeed increment of the wheel was 0.003 cm/pass of the workpiece. The grinding was done under a water flood. The cut data is reported below in Table VIII.

EXAMPLE 27

This example illustrates a coated abrasive segment using a calcium carbonate filler with an amino silane coupling agent in the bond system.

Example 27 was prepared and tested in the same manner as Example 26 except an amino silane coupling agent was added to the bond system. The amino silane was obtained from Union Carbide, under product number A1100, and one percent based on the filler weight was added in situ to the bond system.

TABLE VIII

Comparison of Amino Silane Modified Calcium Carbonate Filler Versus a Non-Modified Calcium Carbonate Filler

| Example | Cut Performance $cm^3$ of 1018 Steel Removed |
|---|---|
| 26 (no amino silane) | 92 |
| 27 (amino silane) | 95 |

The amount of steel removed was the same (within experimental error). Thus, there was essentially no difference in performance. This data supports a conclusion that silane coupling agents will not bond to calcium carbonate filler. Also, it supports a conclusion that a major role of the coupling agent, when added to a coated abrasive bond systems according to the present invention is to act as a bridge between the filler and resin. The coupling agent appears to have little other effect. That is, coupling agent/abrasive interactions appear unimportant.

Example 27 demonstrated that an amino silane does not appear to couple to calcium carbonate; however, zircoaluminates do. Examples 28 and 29 show differences in bonding system viscosity when a zircoaluminate coupling agent is used in the bond system. Viscosity improvements (reduction) are generally equated with coupling agent activity in causing bridging.

EXAMPLE 28

A bond system was prepared comprising 52% by weight calcium carbonate filler (average particle size 4 microns) and 48% by weight a resole phenolic resin. This was diluted with solvent to 84% solids. The viscosity was measured using a Brookfield viscometer model #LTV, spindle number 3, at 6 rpm. The temperature of the resin tested was 41° C. The viscosity measurements are reported in Table IX.

EXAMPLE 29

Example 29 was prepared and tested in the same manner as Example 28, except a zircoaluminate coupling agent was added to the bond system. The bond system comprised 52% by weight a calcium carbonate filler (average particle size of 4 micron); 1% by filler weight of a zircoaluminate coupling agent, obtained from Cavedon Chemical Co., under the designation of Cavco Mod APG-X; and 48% by weight a resole phenolic resin.

TABLE IX

| Comparison of Viscosities | |
|---|---|
| Example | Viscosity (Centipoises) |
| 28 (no coupling agent) | 5000 |
| 29 (coupling agent) | 600 |

There was a dramatic drop in viscosity using the coupling agent. This is attributed to the zircoaluminate acting as a bridge between the calcium carbonate filler and the resole phenolic resin.

Example 30 and 31 compare abrading performance using a zircoaluminate coupling agent in the bond system.

EXAMPLE 30

The backing employed in the example was the same as in Example 1. A make bond system was prepared that comprised 52% by weight calcium metasilicate, obtained from NYCO Company under the tradename NYAD ® 325 wollastonite, and 48% by weight a resole phenolic resin. A solvent was added to the bond system to form an 84% solids make coat solution. The make coat was applied to the backing with an average wet weight of 180 grams/square meter. Immediately thereafter, grade 50 alumina zirconia mineral was applied with an average weight of 610 grams/square meter. The resulting composite was pre-cured for 120 minutes in an oven set at 88° C. Next, a size coat was applied, at an average wet weight of 270 grams/square meter. The size bond system was the same as the make bond system except a 78% solids solution was used. After size coating, the coated abrasive material was subjected to a pre-cure of 120 minutes at 88° C. and then a final cure of 10 hours at 100° C. The coated abrasive material was flexed and attached to the periphery of a metal wheel. The effective cutting area of the abrasive segment was 2.54 cm by 109 cm. The workpiece abraded by these segments was 1018 steel, 1.27 cm width by 36 cm length by 10 cm height. The metal wheel speed was 1500 rpm or 1674 surface meters per minute. The table speed at which the workpiece traversed was 20 meters/minute. The downfeed increment of the wheel was 0.0035 cm/pass of the workpiece. The grinding was done under a water flood. The cut data is reported in Table X.

EXAMPLE 31

The coated abrasive segment for Example 31 was prepared and tested in the same manner as Example 30, except a coupling agent was added to the bond system. One percent based on the filler weight of a zircoaluminate, obtained from Cavedon Chemical Co. under the designation Cavco Mod APG-X, was used to pretreat the calcium metasilicate.

TABLE X

| Comparison of a Non-Modified Bond System With A Zircoaluminate Modified Bond System | |
|---|---|
| Example | Cut Performance $cm^3$ of 1018 Steel Removed |
| 30 (no coupling agent) | 106 |
| 31 (zircoaluminate coupling agent) | 116 |

A slight performance increase was achieved with the zircoaluminate coupling agent.

Examples 32 and 33 show differences in bonding system viscosity when a titanate coupling agent is used in the bond system. Viscosity improvements (reduction) are generally equated with coupling agent activity in causing bridging.

EXAMPLE 32

A bond system was prepared comprising 52% by weight calcium metasilicate purchased from NYCO Company, under the tradename NYAD ® 400 Wollastonite and 48% by weight a resole phenolic resin. This was diluted with solvent to 84% solids. The viscosity was measured using a Brookfield viscometer model #LTV, spindle number 3, at 6 rpm. The temperature of the resin was 20° C. The viscosity measurements are reported in Table XI.

EXAMPLE 33

Example 33 was prepared and tested in the same manner as Example 32, except the calcium metasilicate was pretreated with a titanate coupling agent. The coupling agent was a 3 to 1 mixture of Ken-React ® KR 283M and Ken-React ® LICA ® 38J. The coupling agents were obtained from Kenrich Chemical Company. The amount of the coupling agent applied to the filler was two percent, based upon the filler weight.

TABLE XI

| Comparison of Viscosities | |
|---|---|
| Example | Viscosity (centipoises) |
| 32 (no coupling agent) | 11,940 |
| 33 (titanate coupling agent) | 6,080 |

A fifty percent reduction in viscosity was achieved using the coupling agent. This may be attributed to the titanate acting as a bridge between the calcium metasilicate filler and the resole phenolic resin.

It is to be understood that while certain embodiments of the present invention have been illustrated and described, the invention is not to be limited to the specific compounds, compositions, or methods described and shown.

What is claimed and desired to be secured by Letters Patent is:

1. A coated abrasive article comprising:
(a) a substrate backing;
(b) abrasive material bound to said substrate backing; and,
(c) a bond system adhering said abrasive material to said substrate backing; said bond system comprising: a resinous adhesive, inorganic filler, and, a coupling agent in an effective amount to provide bridging association between the adhesive and the filler.

2. An article according to claim 1 wherein:

(a) said coupling agent is selected from the group comprising: silane-, titanate- and zircoaluminte-coupling agents, and mixtures thereof.

3. An article according to claim 2 wherein:

(a) said filler comprises from about 1–65% of the bond system, by volume.

4. An article according to claim 3 wherein:

(a) said coupling agent comprises from about 0.1–5.0% by weight, of the filler weight.

5. An article according to claim 1 wherein:

(a) said filler comprises from about 1–65% of the bond system, by volume.

6. An article according to claim 3 wherein:

(a) said coupling agent comprises from about 0.1–5.0% by weight, of the filler weight.

7. A coated abrasive article according to claim 1 wherein:

(a) said article includes a make coat of adhesive and a size coat of adhesive; and, (b) said bond system comprises at least one of said make coat of adhesive and said size coat of adhesive.

8. A coated abrasive article according to claim 1 wherein:

(a) said filler includes calcium carbonate therein; and, (b) said coupling agent includes a zircoaluminate therein.

9. A coated abrasive article according to claim 1 wherein:

(a) said resinous adhesive is selected from the group comprising: phenolic resins, urea-formaldehyde resins, melamine formaldehyde resins, epoxy resins, acrylate resins, polyester resins, urethane resins, isocyanates, and combinations and mixtures thereof; and, (b) said coupling agent is selected from the group comprising: amino silane coupling agents, epoxy silane coupling agents, and mixtures thereof.

10. A coated abrasive article according to claim 1 wherein.

(a) said resinous adhesive comprises a phenolic resin;

(b) said filler comprises calcium metasilicate; and, (c) said coupling agent comprises an amino silane coupling agent.

11. A coated abrasive article according to claim 10 wherein:

(a) said substrate comprises a woven polyester cloth.

12. A coated abrasive article according to claim 1 wherein:

(a) said resinous adhesive comprises a phenolic resin;

(b) said filler comprises calcium metasilicate; and, (c) said coupling agent comprises an epoxy silane coupling agent.

13. A coated abrasive article according to claim 12 wherein:

(a) said substrate comprises a woven polyester cloth.

14. A coated abrasive article according to claim 12 wherein said substrate comprises a vulcanized cotton fibre backing.

15. A coated abrasive article according to claim 1 wherein:

(a) a thickness of a composite of said abrasive material and bond system is about 0.01–2.0 mm.

16. An improved method of preparing a coated abrasive article having a substrate backing, an abrasive material bound to the substrate backing, and an inorganic filler/organic resin bonding system adhering the abrasive material to the backing; said method including a step of:

(a) providing a coupling agent in the inorganic filler-/organic resin bonding system in an effective amount to provide a bridging association between the adhesive and the filler.

17. An improved method according to claim 16 wherein:

(a) said coupling agent is selected from the group comprising: silane-, titanate- and zircoaluminate-coupling agents, and mixtures thereof.

18. An improved method according to claim 17 wherein said filler comprises from about 1–65% of the bond system, by volume.

19. An improved method according to claim 18 wherein said coupling agent comprises from about 0.1–5.0% by weight, of the filler weight.

20. A method of improving water insensitivity of an abrasive article having a substrate backing, an abrasive material bound to the substrate backing, and an inorganic filler/organic resin bonding system adhering the abrasive material to the backing; said method including a step of:

(a) providing a coupling agent in the inorganic filler-/organic resin bonding system;

(i) said coupling agent being selected from the group comprising silane- and zircoaluminate-coupling agents, and mixtures thereof; and, (ii) said coupling agent comprising about 0.1–5.0%, by weight, of the weight of filler.

21. The method according to claim 20 wherein said filler comprises from about 1–65% of the bond system, by volume.

22. The method according to claim 21 wherein:

(a) said resinous adhesive comprises a phenolic resin;

(b) said filler comprises calcium metasilicate; and, (c) said coupling agent comprises an amino silane coupling agent.

* * * * *